US005746544A

United States Patent [19]

Baghoomian

[11] Patent Number: 5,746,544

[45] Date of Patent: May 5, 1998

[54] PROCESS AND STRUCTURE FOR REDUCING ROADWAY CONSTRUCTION PERIOD

[75] Inventor: Hovik Baghoomian, Salt Lake City, Utah

[73] Assignees: Hovik Baghoomian; Technology Licensing Co. LLC, Ashland, Ky.

[21] Appl. No.: 517,876

[22] Filed: Aug. 24, 1995

[51] Int. Cl.[6] ..... E02D 5/60

[52] U.S. Cl. ..... 405/229; 404/43; 405/258

[58] Field of Search ..... 405/229, 218, 405/219, 220, 258; 404/43

[56] References Cited

U.S. PATENT DOCUMENTS

| | | | |
|---|---|---|---|
| 776,419 | 11/1904 | Platt | 405/229 X |
| 1,254,401 | 1/1918 | Cole et al. | 404/43 |
| 3,460,446 | 8/1969 | Finsterwalder et al. | 404/43 X |
| 5,255,996 | 10/1993 | Kiat et al. | 404/43 |
| 5,486,071 | 1/1996 | Bullivant | 405/229 |

FOREIGN PATENT DOCUMENTS

| | | | |
|---|---|---|---|
| 1247846 | 10/1990 | France | 404/43 |
| 326699 | 6/1935 | Italy | 404/43 |
| 565298 | 8/1975 | Switzerland | 404/43 |

*Primary Examiner*—Dennis L. Taylor
*Attorney, Agent, or Firm*—Richard C. Willson, Jr.

[57] ABSTRACT

Compression of soft subsoils to support loads such as roadways, widened roadways, etc. with conventionally accomplished product piling surcharge onto the subsoils for a time long enough to compress them. The speed and undesirable compression (which often causes interference with aquifers) can be avoided by installing isolation slabs supported at or near the grade of the subsoil by caps resting on piles driven to sufficient depths to support the intended load. Fill can then be placed on the isolating slabs without the undesirable compression of the subsoil.

16 Claims, 6 Drawing Sheets

PROCESS AND STRUCTURE FOR REDUCING ROADWAY CONSTRUCTION PERIOD

BACKGROUND OF THE INVENTION

I. Field of the Invention

The present invention relates to the field of civil engineering, particularly the reduction of embankment construction period on soft, compressible soils. In the specially preferred applications include a reduction of construction period in the widening of roadways and allows widened roadways to be constructed on a more narrow right-of-way.

II. Description of the Prior Art

Surcharging of compressable soil layers with surcharge of removable fill is a conventional way to avoid subsidence after construction.

III. Problems Presented by Prior Art

Though the use of the components of the present invention, especially piles, caps and slabs has found wide application in civil engineering generally, the techniques and structures of the present invention have not been recited in any prior art known to the inventor.

The widening of roadway embankments on soft soils is frequently accomplished by of use of surcharge to expedite soil consolidation. Soil settlement due to embankment loading has to be lowered to a tolerable level prior to pavement construction. The resulting subsoil settlement can influence a relatively wide area on either side of the roadway, requiring the purchase of additional quantities of expensive right-of-way. To further expedite subsoil settlement, the conventional solution often requires the installation of expensive sand drains or wick drains and even then may require months or years for subsoil settlement to be complete, so usually it is not practical. The resulting settlement can damage the existing roadbed and adjoining structures and the cost of the surcharge and foundation treatment can be an important factor in the total cost of roadway widening projects. Surcharging of the widened portion has a limited effect particularly in regions of the country where years are required to allow complete settlement and pavements experience ongoing subsidence and cracking for years after completion of construction. Maintenance becomes a continuous problem.

SUMMARY OF THE INVENTION

According to the invention, settlement and resulting disruption of the soft subsoil layers is avoided or at least substantially reduced, permitting preservation of the ecology, reducing the width of right-of-way which must be purchased, eliminating interference with aquifers flowing through the subsoil and permitting the construction of the widened roadway without the usual months or years of delay to allow completion of settlement.

According to the invention, conventional pilings, metal, concrete or even wood or composite materials, such as fiberglass, are driven or poured in place so as to penetrate vertically through subsoils to a depth of 2–100 feet, more preferably 30–70, and most preferably 40–60 feet. The depth of piles must be sufficient to provide sufficient side friction to support the intended load. The diameter of each pile will generally be in the range of 4–24, more preferably 6–18 and most preferably about 8–16 inches. Conventional piles, readily available and economical to put in place, are to be preferred.

Onto each pile, either as a separate piece or integral with the pile, there is added a cap which is of larger diameter than the pile and serves to carry the load from the isolation slabs described below down onto the pile. These caps are preferably square with a mating surface adapted to mate with the top of the pile, e.g. a pair of intersecting slots at right angles to each other which mate with a pair of intersecting tongues either in the pile or in the cap. Other mating devices on the cap, with the matching device on the pile include a collar which surrounds the pile, or a pin which enters a hole in the pile or the caps will generally be 1–12 inches, more preferably 2–8 inches and most preferably about 3–4 inches in vertical thickness when installed. Cap horizontal dimensions will generally be in the range of about 1.5–10, more preferably 2–10 and most preferably about 5–8 feet. The isolating slabs can be made of any reasonably rigid material including concrete, preferably reinforced with rigid reinforcing bar or mesh, fiberglass—polyester or other plastic-reinforcing fiber composites, or any other material strong enough and rigid enough to support the intended. The isolating slabs can be pre-cast, prestressed, or poured in place, preferably using expendable forms such as wood, cardboard or plastic. Though not preferred, a monolithic layer could be substituted for the individual isolating slabs with some sacrifice in the handleability, and possibly in total cost of installation.

The present invention may be utilized in conjunction with optional retaining walls as shown in FIGS. 1 & 2. The retaining walls can be of conventional design e.g. reinforced earth, poured concrete, concrete block construction with integral tie-ins, MSD walls, and other conventional retaining walls. The retaining wall, when employed with the present invention, can still further reduce the width of right-of-way which must be purchased by truncating the natural slope of the edge of the fill.

I. General Statement of the Invention

According to the invention settlement of soft subsoils by applied embankment loads such as roadways, widened roadways, etc. is conventionally accomplished by piling surcharging accompanied by ground water treatment (wick or sand drains) involves a long delay in construction and adversely influences adjoining land and structures. The delay and undesirable settlement (which often also causes interference with aquifers) can be avoided by installing isolation slabs supported at or near the ground level by caps resting on piles driven to sufficient depths to support the intended load. Fill can then be placed on the isolating slabs without the undesirable settlement of the subsoil.

Installation Process

Following pile installation at certain internals in a grid system caps are placed on piles on which isolating slabs "Isopads" are anchored. Following Isopad™ placement, embankment placement begins to completion of pavement construction.

II. Utility of the Invention

The present invention substantially avoids the settlement of soft subsoil layers, e.g. clays, silts, etc. Conventionally, when a roadway embankment is built, a settlement will occur which may range from a few inches up to several feet and may affect the soft subsoil to a depth of 40–50 feet. The settlement can substantially affect the surrounding environment, causing reduction in soil porosity, thus interfering with flowthrough aquifers and increasing salinity at the subsoil surface.

As an additional advantage of the invention, it permits minimum disruption of traffic over existing roadways or side service roads, minimizing the disruption of the subsoil which would otherwise damage existing roads and adjoining structures, and avoids narrowing of the existing roads during construction with resulting traffic jams.

Still another advantage of the invention is its enhancement of the ability of the finished roadway to withstand earthquakes and other ground shocks. The isolating slabs transfer dynamic loads to piles which are less susceptible to failure by blasting or by earthquakes. Additionally, even if the loose subsoil layers are liquefied, become non-load bearing, the structure of the piles and isolating slabs continues to maintain, and support the roadway and embankment which it supports, and the pilings transmit the load down to a depth below the normal depth at which liquefaction will occur during an earthquake.

Table A summarizes preferred, more preferred and most preferred parameters of the process of the invention. Table B summarizes preferred, more preferred and most preferred parameters of the composition of components of the invention. Table C summarizes preferred, more preferred and most preferred parameters of the apparatus of the invention.

TABLE A

| PROCESS | | | | |
|---|---|---|---|---|
| Parameter | Units | Preferred | More Preferred | Most Preferred |
| Pile driving | | vibration, impact, | — | vibration |
| Pile positioning | | at slab corners, edges or midpoints | — | at slab corners |

TABLE B

| COMPOSITIONS | | | | |
|---|---|---|---|---|
| Parameter | Units | Preferred | More Preferred | Most Preferred |
| Slab material | — | concrete, plastic | — | concrete |
| Slab stiffening | — | corrugated reinforced rod, fiber | — | concrete |
| Cap material | — | Concrete, plastic | — | concrete |
| Cap stiffening | — | concrete, plastic, rein forced rod, fiber | — | reinforced concrete |
| Pile material | — | concrete, metal, plastic | metal | concrete + pipe |
| Pile stiffening | — | concrete, plastic, reinforced rod, fiber | pipe with concrete fill | reinforced concrete |

TABLE C

| APPARATUS | | | | |
|---|---|---|---|---|
| Parameter | Units | Preferred | More Preferred | Most Preferred |
| Slab shape | — | rectangle, square, triangle | rectangle, square | square |
| Slab width | feet | 3–20 | 4–15 | 5–10 |
| Slab length | feet | 3–20 | 4–15 | 5–10 |
| Slab thickness | inches | 1–18 | 2–12 | 2.5–4 |

TABLE C-continued

| APPARATUS | | | | |
|---|---|---|---|---|
| Parameter | Units | Preferred | More Preferred | Most Preferred |
| Cap shape | — | square, rectangular, circle, etc | | square |
| Cap width | feet | 1.5–10 | 2–10 | 2–3 |
| Cap length | feet | 1.5–10 | 2–10 | 2–3 |
| Cap thickness | inches | 1–12 | 2–8 | 3–4 |
| Pile x-section | | square, round | round | round |
| Pile diameter | inches | 4–24 | 6–18 | 8–16 |
| Pile length | feet | 2–100 | 30–70 | 40–60 |
| Cap - slab interlock | — | integral slots and ribs, cap-into-pile pile-into-cap | — | slots and ribs |

BRIEF DESCRIPTION OF THE DRAWINGS

FIG. 2 shows how the stress can crack adjacent houses and other structures and generally require the purchase of considerably wider right-of-way, all as detailed more fully in Example 2.

DESCRIPTION OF THE PREFERRED EMBODIMENTS

EXAMPLE 1

(The invention supporting fill for a roadway widening project)

Figure 1:
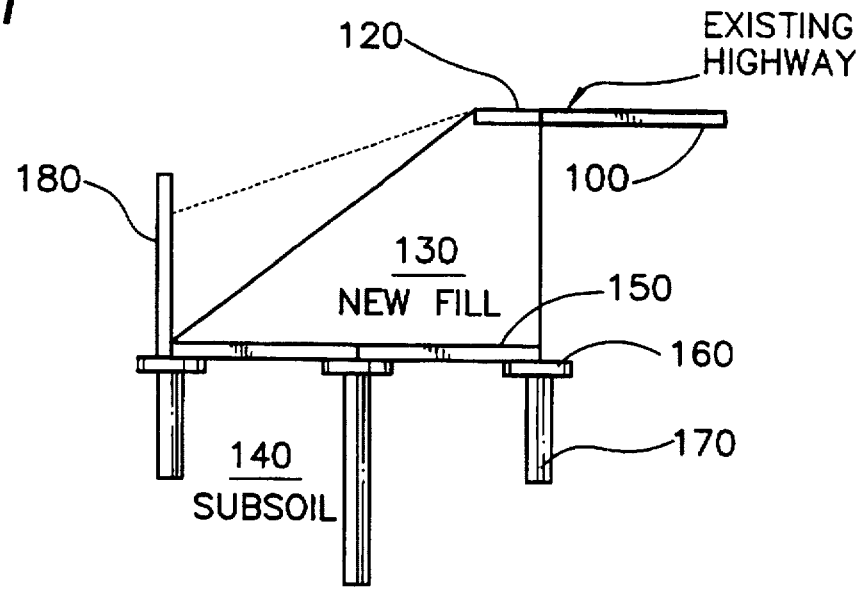
FIG. 1 is a cross-section of an existing highway built against retaining walls which is to be widened showing the optional new retaining wall and slabs, caps and piles of the present invention in place to minimize the necessary right-of-way, all as described more fully in Example 1.

Referring to FIG. 1, an existing roadway 110 is to be widened by a new highway 120 which is to be supported by new fill 130, above soft subsoil 140. Isolating slabs 150, approximately 7 by 12 feet and 3 inches thick, made of fiber reinforced concrete with sufficient reinforcing bar added to support the load of the new fill 130, are supported on caps 160 which transmit the load down into pile 170 which penetrates the soft subsoil sufficiently to support the load. The piles are driven by conventional vibratory techniques and spaced so that the caps surmounting them contact the four corners of the isolating slabs 150. An optional retaining wall 180 is provided. This technique reduces substantially the right-of-way necessary to be purchased for the new highway widening, avoids substantial compression of the subsoil 140, permitting aquifers in the subsoil to continue to function and avoiding the ecological impact of closing those aquifers by compression. Further, the new fill can be added immediately after the laying of slabs 150 without wait for subsidence and without the need to add and remove surcharge as in conventional techniques.

EXAMPLE 2

(The Invention With Optional Sheet Piles)

Figure 2:
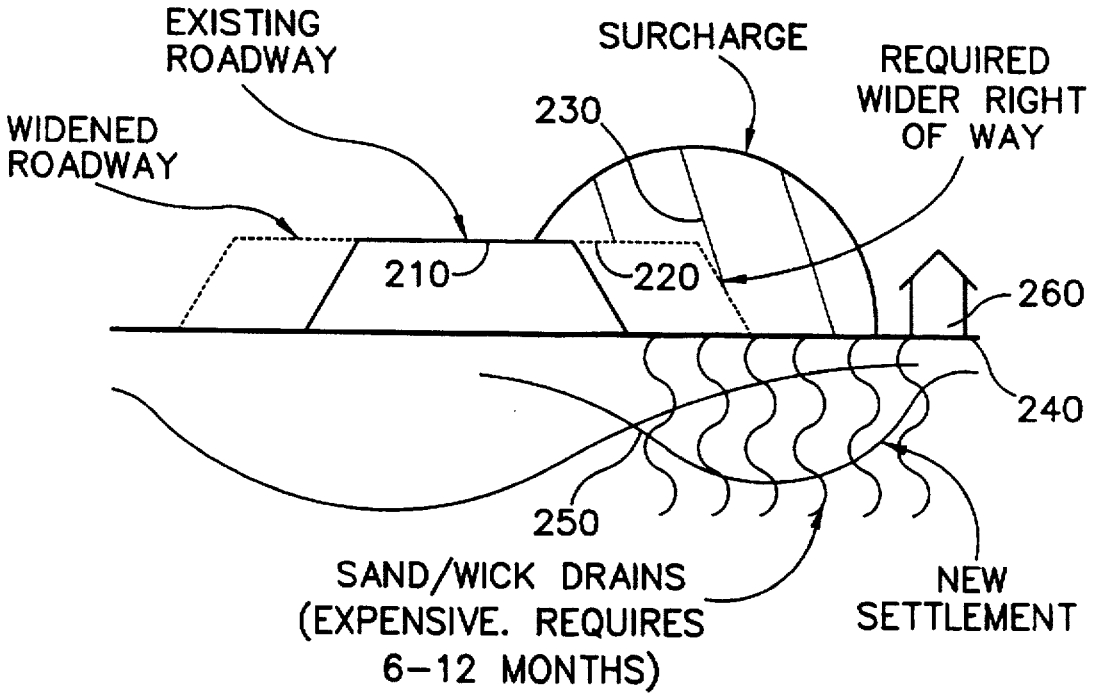
FIG. 2 PRIOR ART
FIG. 2 is a schematic section diagram of a similar roadway widening project showing the surcharge conventionally used to compress the soft subsoil to consolidate it for the support of the widened roadway.

Referring to FIG. 2, existing roadway 210 is to be widened by adding new highway 220. Surcharge 230 is added conventionally to compress the subsoil layer 240 and the subsoil causes cracking of housing closely adjacent to the bottom of the fill and requires extra right-of-way width due to the effect on adjacent structures. A stress distribution 250 arises due to the compression of the soft subfill 240. This stress distribution is cut off from the area adjacent to the right-of-way by driving stiff rigid sheet pile of interlocking conventional design to form a subterranean wall which cuts off the stress from the subsidence and compression of the soft subsoil. This avoids the effect of the stress on building 260, narrowing the required right-of-way which must be purchased.

EXAMPLE 3

(The invention with round caps)

Figure 3:
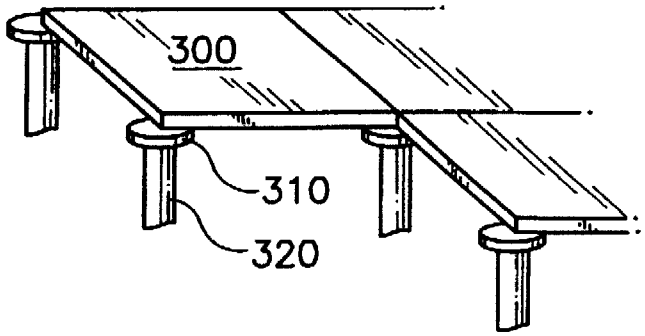
FIG. 3 shows the slabs 300, the caps 310 (of circular design in this embodiment) and the piles 320 of the invention in place with the slabs a few inches above the grade of the existing subsoil.
Figure 4:
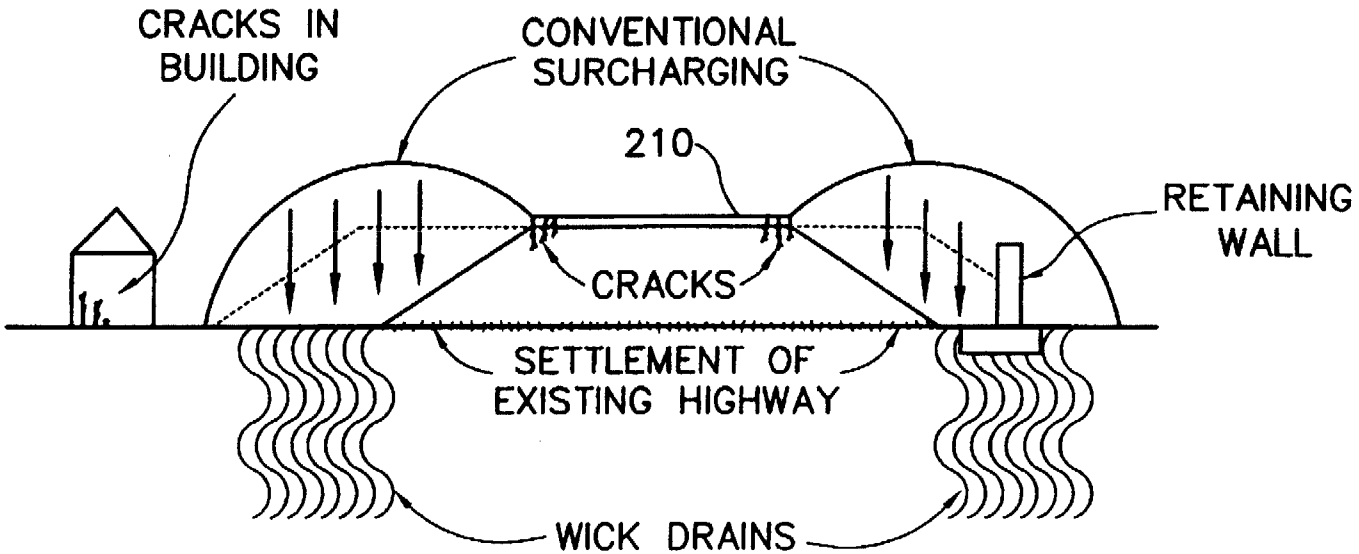
FIG. 4 PRIOR ART
FIG. 4 shows in more detail a widened surcharge and the settlement resulting from the compression of the soft subsoil. This settlement can also interfere with aquifers and require wick drains adding to the expense of the conventional surcharge process, which is avoided by the present invention.
Figure 5A:
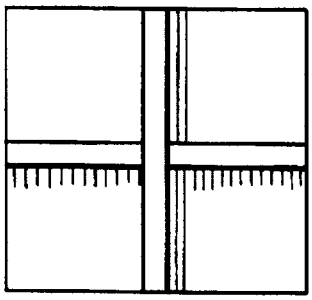
FIG. 5*a* shows a bottom view of the buffer cap of the invention showing the preferred long rib and short rib which key into the recessed slots of the 5*b* the top of the pile.
Figure 5B:
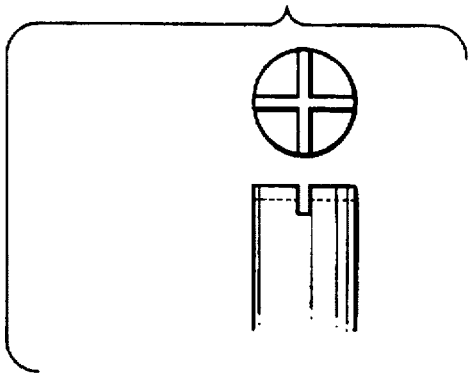
FIG. 5*c* shows in cross-section the long rib of the buffer cap shown in FIG. 5*a* and FIG. f.
FIG. 5*d* shows the short rib of the buffer cap also shown in FIGS. 5*a* and 5*f*.
FIG. 5*e* shows the buffer cap installed on the recess cap of the deep support system (pile).
FIG. 5*g* shows in perspective a series of buffer caps installed on piles and surmounted by one slab to show the completed system of the invention.
Figure 5C:
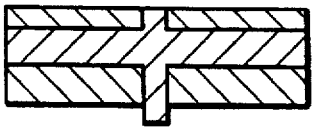
Figure 5D:
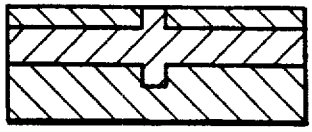
Figure 5E:
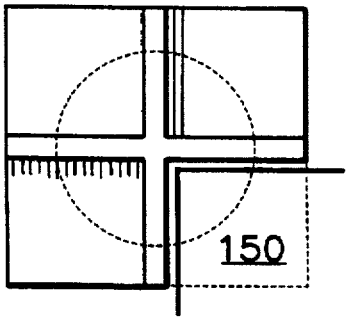
Figure 5F:
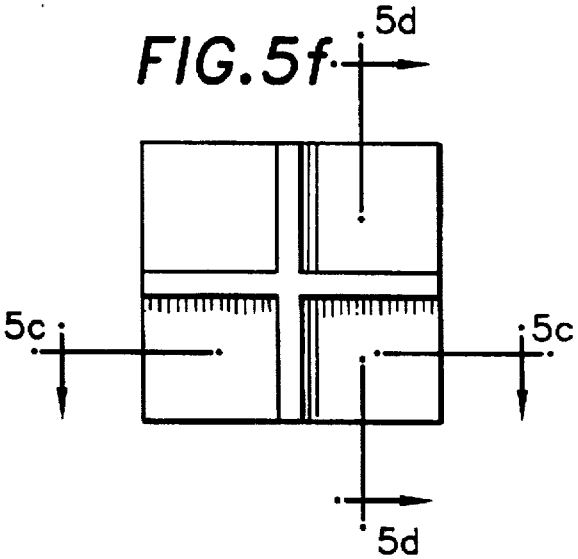
Figure 5G:
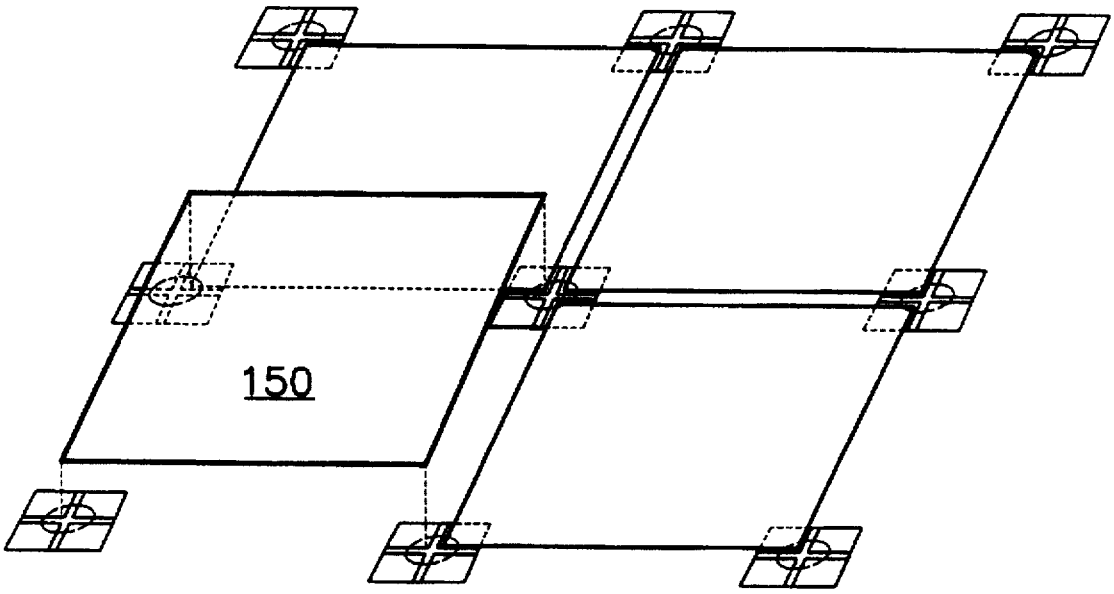
Figure 6A:
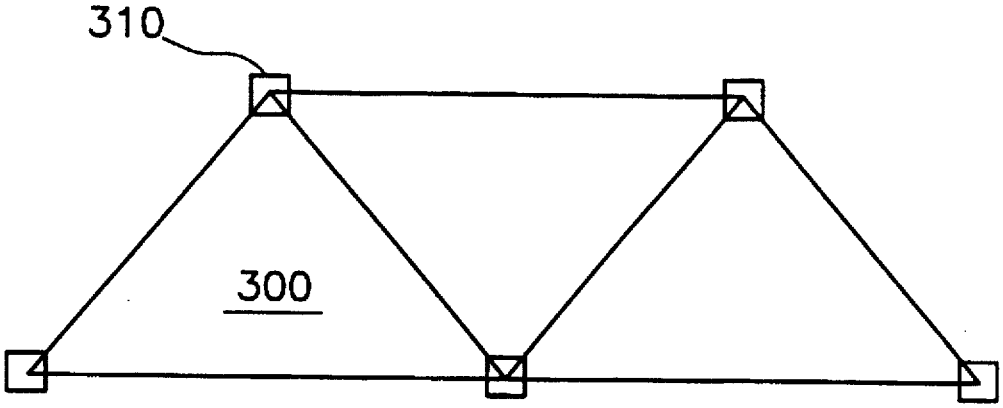
FIG. 6 shows that other juxtapositioning may be used between the buffer caps and the slabs; the slabs may be triangular, each being supported by a buffer cap and piling on each corner of each triangle or, alternatively, the buffer caps may be placed near the center of each edge of the slab so that the slab is supported in cantilever fashion.
Figure 6B:
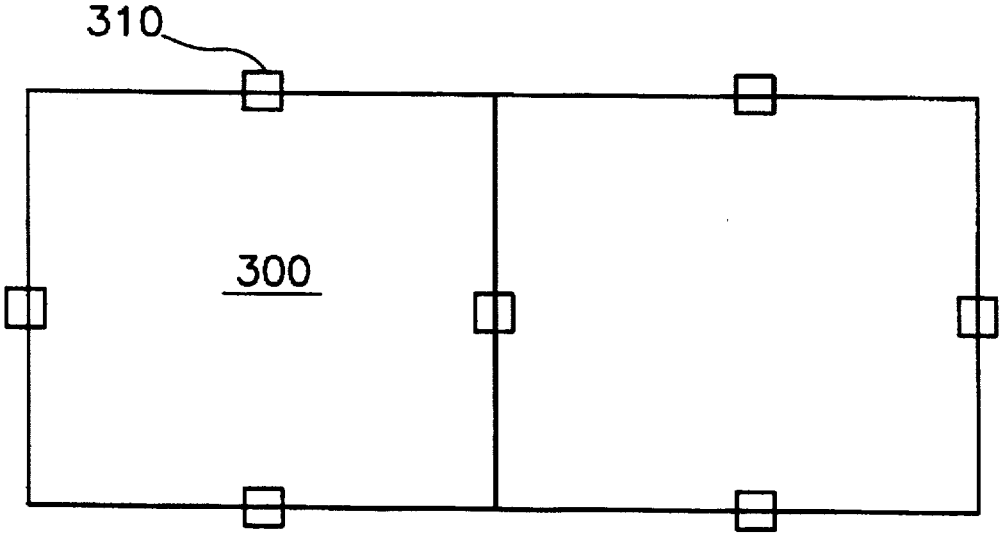
Figure 7A:
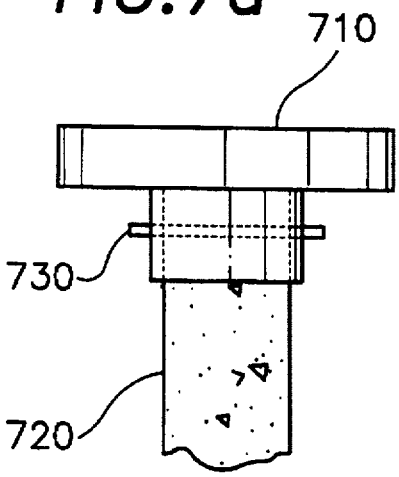
FIG. 7*a* shows the buffer cap surmounting and surrounding the pile.
Figure 7B:
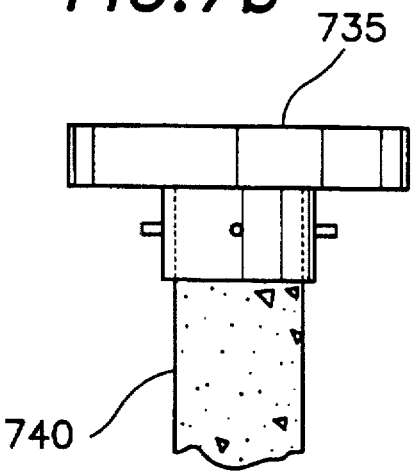
FIG. 7*b* shows the buffer cap fitted inside of the pile.
Figure 7C:
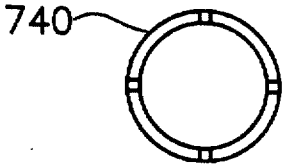
FIG. 7*c* shows the pile of FIG. 7*b* in plan view and FIG. 7*d* shows the pile of FIG. 7*b* in cross-section, indicating it as a pipe filled nearly to the top with concrete and having holes for locking pins.
Figure 7D:
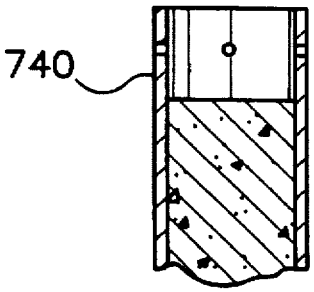
Figure 7E:
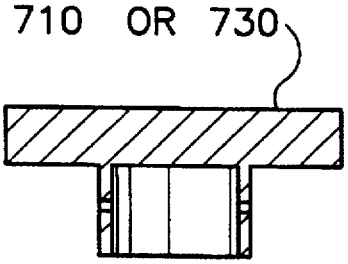
FIG. 7*e* shows the cap of FIG. 7*a* and FIG. 7*f* shows the circular, or alternatively, square pile cap. Many variations of the interlock between the pile cap and the pile itself can be utilized with the invention and the pile cap and pile can even be made integral with each other.
Figure 7F:
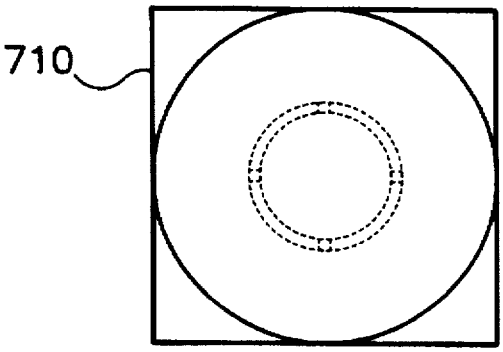
FIG. 7 shows various other combinations of the deep support system (pile) being fitted with the buffer cap.

Referring to FIG. 3, the isolating slabs 300 similar to those described in Example 1 are supported by caps of a round design 310 resting on piling 320 of the same type described in Example 1. Details of these caps and their interconnection with the piling are shown in FIG. 7 which describes a number of alternatives. FIG. 7*a* shows a female cap 710 fitted over a piling 720 and locked in place with a retaining pin 730. FIG. 7*b* shows a male cap 730 fitted into a piling 740 which terminates in a female end (made by filling a pipe pile almost to the top with concrete as shown in FIG. 7*c* and FIG. 7*d* a retaining rod may be optionally used to hold the piling in place. FIGS. 7*e* and FIGS. 7*f* show the cross-section and the plan view, respectively, of a cap of the configuration of 710 (female) or of 730 (male), depending upon the variable diameter chosen for the mating portion of the cap. As described, the cap may be either circular or square at its top.

MODIFICATIONS

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein. Other, less preferred, applications of the invention include not only roadways but also parking lots, garages and other structures.

Reference to documents made in the specification is intended to result in such patents or literature being expressly incorporated herein by reference.

What is claimed is:

1. A structure for facilitating the widening of existing roadway while reducing: disruption of traffic, required right-of-way, closing of underlying acquifers, and soil compression, comprising in combination:

a. an existing roadway;

b. a layer of subsoil of compressible characteristics, extending substantially along the edge of said existing roadway;

c. three or more piles penetrating said soft subsoil to a depth sufficient to provide sufficient side friction to support a load on said piles, said piles terminating at an upper elevation substantially at the top of said layoff soft subsoil;

d. an individual, substantially rigid, cap surmounting each of said piles so as to expand the upper end of said pile to distribute load down into said pile;

e. at least two isolating slabs each being a substantially rectilinear figure in plan view and each contacting at least one cap so that each of said slabs rests on and is supported by a plurality of said caps, each of said slabs being rigid and resistant to substantial deflection and located substantially at the upper surface of said layer of soft subsoil, said slabs lying in a substantially horizontal plane and being located so that some of said caps each support a plurality of said slabs;

f. a soil burden, roadway or other load resting on said slabs so that said slabs transmit the load onto said piles, whereby said slabs substantially isolate said layer of soft subsoil from said load.

2. A process for minimizing disruption to existing traffic, acquifers and adjacent property extending along the edge of a roadway which is to be widened, said process comprising in combination:

a. penetrating a compressible subsoil layer adjacent to the roadway with a plurality of piles spaced one from another in a substantially regular pattern and extending to a depth sufficient to provide sufficient side friction to support a load on said piles, each of said piles extending downward fro a top;

b. capping each of the piles with an individual cap having greater crossectional area than the top of the pile it caps;

c. placing isolating slabs so that each slab is supported by one or more of said caps;

d. adding new fill, roadway or other load onto said isolating slabs so as to transmit the load onto said slabs, thence onto said caps and finally onto said piles to isolate said subsoil from said load, whereby substantial compression of said subsoil layer is eliminated.

3. A process according to claim 2 wherein said isolating slab is about 2–6 inches in vertical thickness and about 3–15 feet in each of its horizontal dimensions.

4. A structure according to claim 1 wherein the isolating slab is substantially square.

5. A structure according to claim 1 wherein a series of said slabs, caps and piles are spaced so as to run substantially adjacent to the edge of an existing roadway which is to be widened.

6. A structure according to claim 1 wherein the caps are located substantially at the corners of the slabs and wherein each caps supports at least a portion of each of a plurality of slabs.

7. A structure according to claim 1 wherein each cap has at least one substantially horizontal rib which interlocks with a groove in said slab or vice versa.

8. A structure according to claim 7 wherein each rib has at least one intersecting rib and each groove has at least one intersecting rib.

9. A structure according to claim 8 wherein one rib protrudes further outward from the cap than the other rib.

10. A process according to claim 1 comprising providing a series of said slabs, caps and piles so spaced as to run substantially adjacent to the edge of an existing roadway which is to be widened.

11. A process according to claim 1 comprising locating the caps substantially at the edges of the slabs so that a single cap can support at least a portion of each of a plurality of slabs.

12. A process to claim 1 comprising providing each cap at its bottom with at least one interlocking means which interlocks with said pile or vice versa.

13. A process according to claim 12 wherein each interlocking means comprises a rib and mating groove.

14. A process according to claim 13 comprising providing one rib which protrudes further outward from the cap than does the other rib.

15. A structure according to claim 1 additionally comprising retaining means supporting the outer edge of said layer which is further from the roadway to be widened, whereby said structure reduces stress transmitted to soils or structures adjacent to said structure.

16. A process according to claim 2 additionally comprising providing retaining means supporting the outer edge of said layer which is further from the roadway to be widened, whereby less stress is transmitted to soils or structures adjacent to said roadway.

* * * * *